US005697320A

United States Patent [19]

Murray

[11] Patent Number: 5,697,320

[45] Date of Patent: Dec. 16, 1997

[54] CONVERTIBLE TOP/UMBRELLA

[76] Inventor: Robert W. Murray, 806 Park Pl., West Palm Beach, Fla. 33401

[21] Appl. No.: 618,633

[22] Filed: Mar. 19, 1996

[51] Int. Cl.[6] ..... B63B 17/00

[52] U.S. Cl. ..... 114/361; 296/216

[58] Field of Search ..... 114/270, 361, 114/364; 296/216

[56] References Cited

U.S. PATENT DOCUMENTS

| | | | |
|---|---|---|---|
| 2,833,296 | 5/1958 | Wooddruff, Sr. | 114/361 |
| 5,303,667 | 4/1994 | Zirkelbach et al. | 114/361 |
| 5,361,717 | 11/1994 | Kobayashi | 114/361 |

*Primary Examiner*—Jesus D. Sotelo

*Attorney, Agent, or Firm*—Norman Friedland

[57] ABSTRACT

A convertible top canopy is pivotally attached to the hull of a multiple seat cruiser jet boat by a simple linkage system consisting of three U-shaped links each of which are attached at the base of the "U" to the canopy, the main link is pivotally and removably attached to the hull and another link is pivotally attached to the main link and the third link is pivotally attached to the second link and pivots to fold and lie against the deck on the stern of the watercraft. Tension straps at the stern and bow attach to the hull and forward and aft U-shaped links to position the canopy relative to the hull in the up position. The canopy is removable from the watercraft by releasing the main link and straps and usable as a cabana or umbrella on the ground by inserting a portion of the main link into the ground and tensioning the forward straps to stakes mounted in the ground.

13 Claims, 3 Drawing Sheets

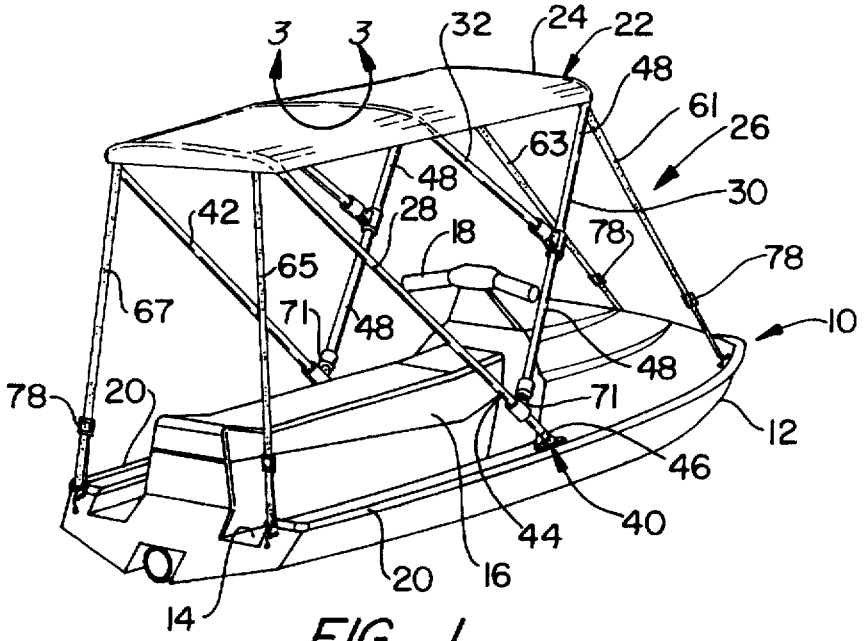
FIG. 1
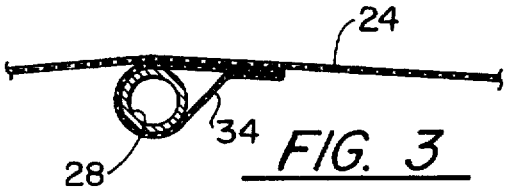
FIG. 3
FIG. 2
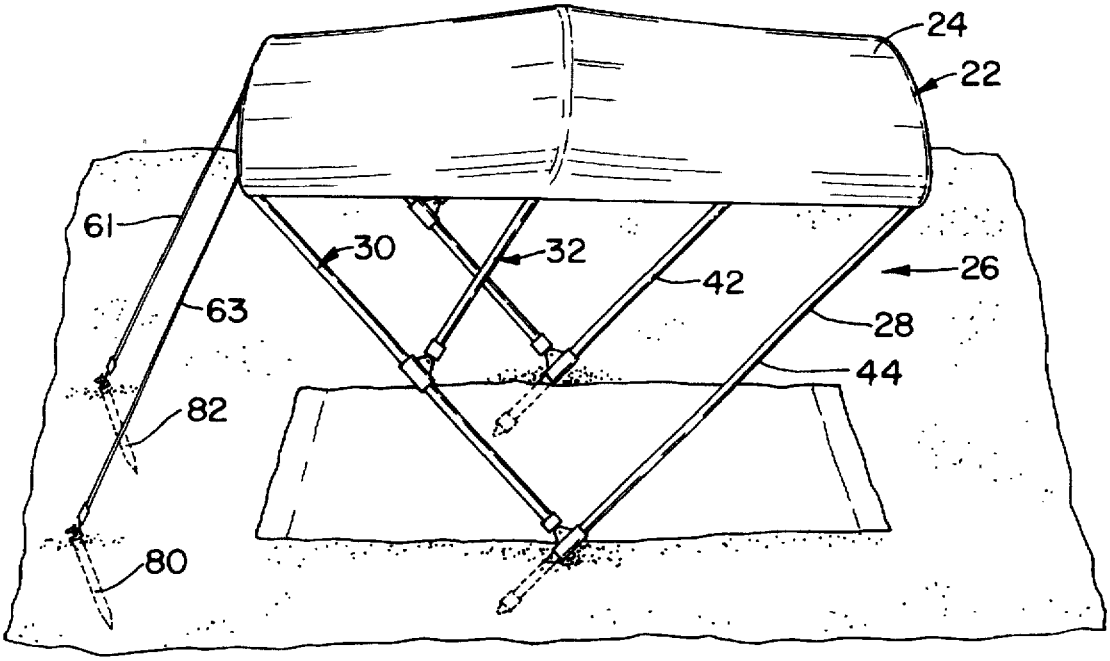

CONVERTIBLE TOP/UMBRELLA

TECHNICAL FIELD

This invention relates to a convertible top for shading out the sun and particularly to a removable convertible top adapted to be fitted on a multiple seat cruiser jet boat and removed for use as a sun covering or umbrella for the beach or the like.

BACKGROUND ART

As is well known in the recreational vehicle technology, multiple seat cruiser jet boats (watercraft) are configured such that the seat for the passenger(s) is located behind the steering wheel or handle bars. The seat is such that the passengers are seated in tandem with the driver of the vehicle whenever there are passengers. Typically, the seat is mounted in the center of the hull and the passengers generally enter from the rear of the boat much like a snowmobile. The seating area is open. One of the problems with these types of recreational vehicles is that the operator and passengers seated in this open area are fully exposed to the environment, especially to the sun.

The prior art discloses several closure devices or canopies that shelter the passengers from the sun. For example, U.S. Pat. No. 5,361,717 granted to Kobayashi on Nov. 8, 1994 utilizes a pivotal cowling made from a composite material normally located in the bow of the boat and when deployed rotates about a pivot axis and is positioned upwardly toward the stern of the boat to rest on a platform and form a sun cover for the passengers. Essentially, the platform is supported to raised gunnels through a pair of upstanding pillars formed on the stern of the boat and the pillars are connected by a cross bar.

The prior art also includes a plethora of canopies or convertible tops that are supported by links that are suitably attached to boats, canoes or campers. While these systems employ linkage systems for supporting the canvas top, they are rather complex structures or are not adaptable to be used on the multiple seat cruiser jet boats. Nor are they adaptable for use as an umbrella that is readily removable from the water jet boat as is the case of the present invention.

Amongst this list of prior art references falling under the category mentioned in the immediate above paragraph include, U.S. Pat. No. 4,683,900 granted to Carmichael on Aug. 4, 1987, entitled "Boat Canopy", U.S. Pat. No. 5,016,558 granted to Oehler on May 21, 1991, entitled "Boat With Retractable Roof", U.S. Pat. No. 5,092,262 granted to Lacy on Mar. 3, 1992, entitled "Adjustable Windshield and Canopy For A Boat", U.S. Pat. No. 4,926,782 granted to Lacy on May 22, 5 1990, entitled "Adjustable Windshield and Canopy For A Boat", and U.S. Pat. No. 5,303,667 granted to Zirkelbach et al on Apr. 19, 1994 entitled "Boat Camper System And Method".

This invention has been tested in its intended environment with winds that were in the 60 knot range without any adverse effect. Of significance is the fact that the canopy is adjustable so that it bears a relationship with the hull of the watercraft. Preferably, the canopy can be adjusted so that it is parallel with the hull. Obviously, it can be adjusted to be angularly disposed relative to the hull to meet the desires of the riders.

Also of significance is the fact that the invention is simple to install and remove from the watercraft and it can be raised and lowered as the need arises. According to the invention the linkage system is pivotable so that the canopy can be folded into a relatively compact envelope and pivotable to lie at the stern of the watercraft without having an adverse impact to the mobility of the watercraft.

The canopy of this invention is readily adaptable for use as an umbrella that can be quickly and easily removed from the boat so as to be used on land. As mentioned above, the canopy is supported to the watercraft by a simple linkage system that includes a pair of U-shaped links (camel back) that attaches to the water craft and four straps strategically located to afford rigidity to the canopy when the watercraft is in motion. All that is necessary for removal of the canopy is the release of these four straps and two quick release pins from camel back hinges. The linkage system is pivotal so that the canopy can fold up like an "accordion" when not in use, as when the top is down on the watercraft or is in storage or is in transit. As will become apparent from the description to follow the canopy is simple to assemble and disassemble on the jet propelled watercraft and is relatively inexpensive.

SUMMARY OF THE INVENTION

The object of this invention is to provide a canopy for a jet propelled watercraft that is characterized as being simple to fabricate and install and relatively inexpensive.

Another object of this invention is that the canopy for the jet propelled watercraft can be easily removed from the watercraft and kept in tact and used as an umbrella or cabana for the beach or the like.

A feature of this invention is the use of a simple linkage system that is adapted to be folded when not in use or when in transit.

Another feature of this invention is that the canopy and linkage system is adjustable by adjustable straps that are so designed to transmit substantially the entire load from the canopy to the hull.

The foregoing and other features of the present invention will become more apparent from the following description and accompanying drawings.

BRIEF DESCRIPTION OF DRAWINGS

FIG. 1 is a perspective view of the canopy in the up position as assembled to a jet propelled watercraft;

FIG. 2 a view of the canopy of FIG. 1 adapted for use as an umbrella; and FIG. 3 is a sectional view taken along section lines 3—3 illustrating the support link attached to the canopy.

DETAILED DESCRIPTION OF THE PREFERRED EMBODIMENT

Figure 4:
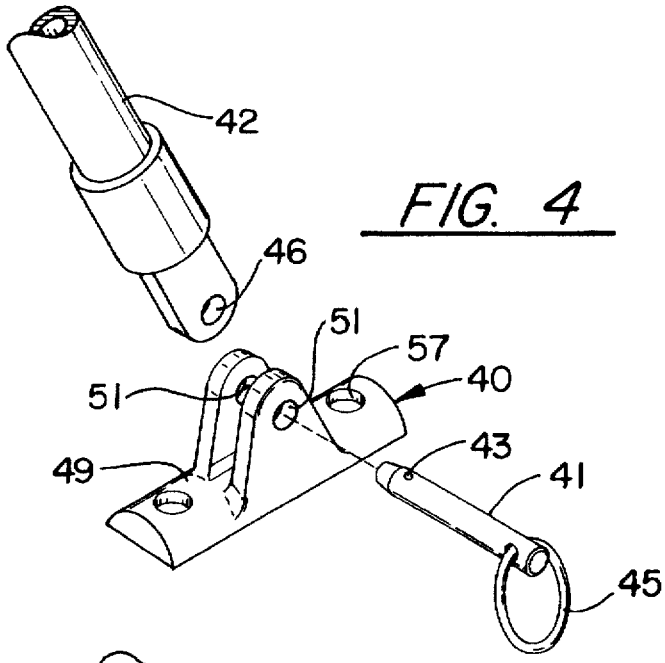
FIG. 4 is a partial exploded view in perspective illustrating the camel back link.

While the preferred embodiment of this invention is being disclosed for use in a jet propelled watercraft it should be understood that the invention can be adapted for use with other vehicles that are designed for land as well as water use.

Referring to FIG. 1 there is shown a well known commercially available watercraft generally illustrated by reference numeral 10 of the jet propelled variety with a hull 12, a deck 14 defining an open cockpit and a central seat 16 on the deck and extending from the bow area to the stern area. The handle bar 18 for steering the craft is mounted just ahead of the seat 16 and is accessible to the rider seated in the front of the watercraft. Passengers sit directly in back of the operator in tandem relationship. As the watercraft is not apart of the invention and for the sake of simplicity and convenience the details thereof are omitted herefrom. It should be understood that the watercraft includes structure for supporting the linkage system utilized to support the canopy.

In this embodiment the raised gunnels 20 on opposite sides of the watercraft carry the appropriate fittings needed for the quick release attachment for releasing the linkage system of the canopy. Also attached to the watercraft in appropriate locations are the fittings for attaching the four straps as will be described in further detail hereinbelow.

Canopy generally illustrated by reference numeral 22 comprises the fabric top 24 which may be fabricated from a suitable canvas or other commercially available material and the linkage system generally indicated by reference numeral 26. The linkage system includes the main U-shaped link 28, a first intermediate U-shaped link 30 and a second intermediate U-shaped link 32. Each link is fabricated from a tubular member or pipe that is bent into the "U"-shaped configuration and preferably made from stainless steel but can be made from other materials such as, for example, aluminum, PVC piping (polyvinychloride), or other metallic or synthetic or composite materials. Preferably the dimensions of the stainless steel tubing are ⅞ inch outer diameter and 0.049 inch wall thickness and the aluminum is ⅞ inch outer diameter and 0.058 inch wall thickness.

Each of the U-shaped links consist of the cross bar portion that extends laterally across the canopy and the leg portions. The cross bar portion is fitted into sleeves formed on the underside surface of the fabric top. For simplicity sake and convenience the attachment to the fabric top of only one link will be described since all the links are attached to the fabric top in a similar manner. As noted in FIG. 3, a sleeve 34 is sewn to the underside of the fabric top 24 and the U-shaped link slides through the open ended channel formed by the sleeve until the cross bar portion is completely inserted therein. At the fore and aft ends of the canopy the canvas material can be folded over to form the sleeve. The main link 28 is the only link that is fastened to the watercraft and the other two links are pivotally mounted in the manner to be described immediately hereinbelow. The watercraft is fitted with two well known commercially available camel back hinges 40 that are secured to each of the raised gunnels 20 and are located intermediate the stern and bow opposite each other. The remote end of leg portion 42 and leg portion 44 of the main U-shaped link 28 carries an eyelet fitting 46 that fits into the recess of the camel back hinges 40. As noted in FIG. 4, camel back hinge is commercially available and includes a generally U-shaped bracket 40 with a spring loaded quick release pin 41 that passes through the eyelet fittings 46 mounted on the end of leg 42 and leg 44 which provides a hinged support therefor. The base 49 of camel back hinge 40 (only one being described) may be permanently mounted to the gunnel or hull of the watercraft via bolts (not shown). The pin 41 which includes the safety spring loaded ball 43 fits into the apertures 51 formed in the upstanding bifurcated members of the base 49. A ring 45 may be attached to the end of the pin 41 for easy removal of the pin. Obviously the ball 43 collapses as the pin passes through the apertures 51 and prevents the pin from inadvertently falling out.

Figure 5:
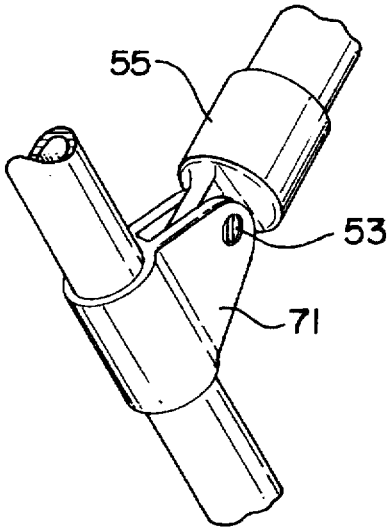
FIG. 5 is a partial view in perspective illustrating the U-shaped bracket and eyelet pivotal connection of the linkage system.

Intermediate U-shaped link 30 is pivotally mounted intermediate the main link 28 and the cross bar or base portion is attached to the fore end of top 24. The leg portion 48 and the leg portion 48 of intermediate link 30 are pivotally attached to the legs 42 and 44, respectively, of the main U-shaped link 28 by any suitable commercially available T-fitting 71. The location of this attachment is rather critical and is close to the gunnels in order to provide sufficient strength to the canopy when the watercraft is in full operation. Since all the intermediate links are similarly connected only one T-fitting 71 and eyelet is being described herein. As noted in FIG. 5 the T-fitting 71 slides onto the tube and is split so that by tightening the bolt 53 the T-fitting squeezes onto the tube and is secured thereto. Eyelet 55 is fitted on the end of the leg of the link similarly to that described with the main link and fits the T-fitting 71 and is pivotally mounted about the axis of bolt 53. As shown in FIGS. 1 and 2, intermediate link 32 is pivotally attached to the intermediate link 30 intermediate the legs 50 and 52 and the cross bar portion is attached to the top 24 intermediate the fore and aft ends.

Figure 6:
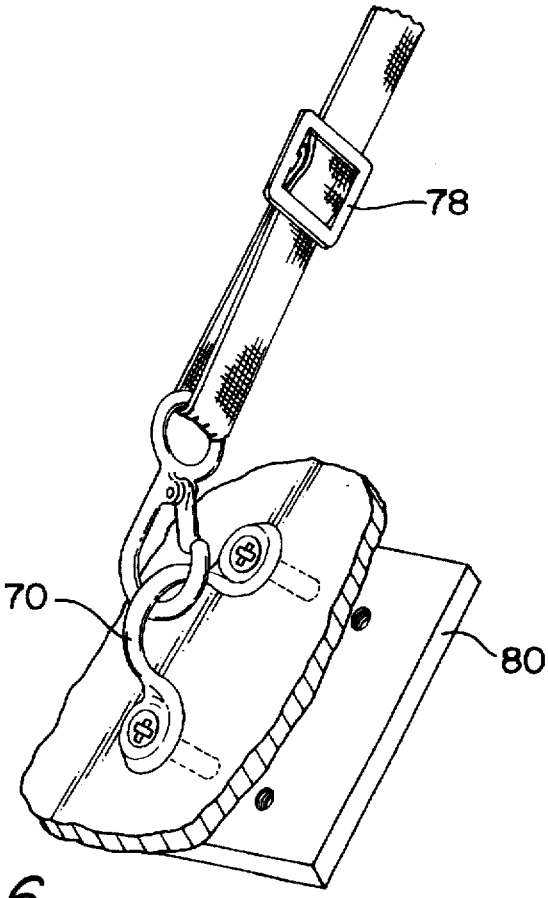
FIG. 6 is a partial exploded view illustrating the adjustable strap and the fittings therefor.
Figure 7:
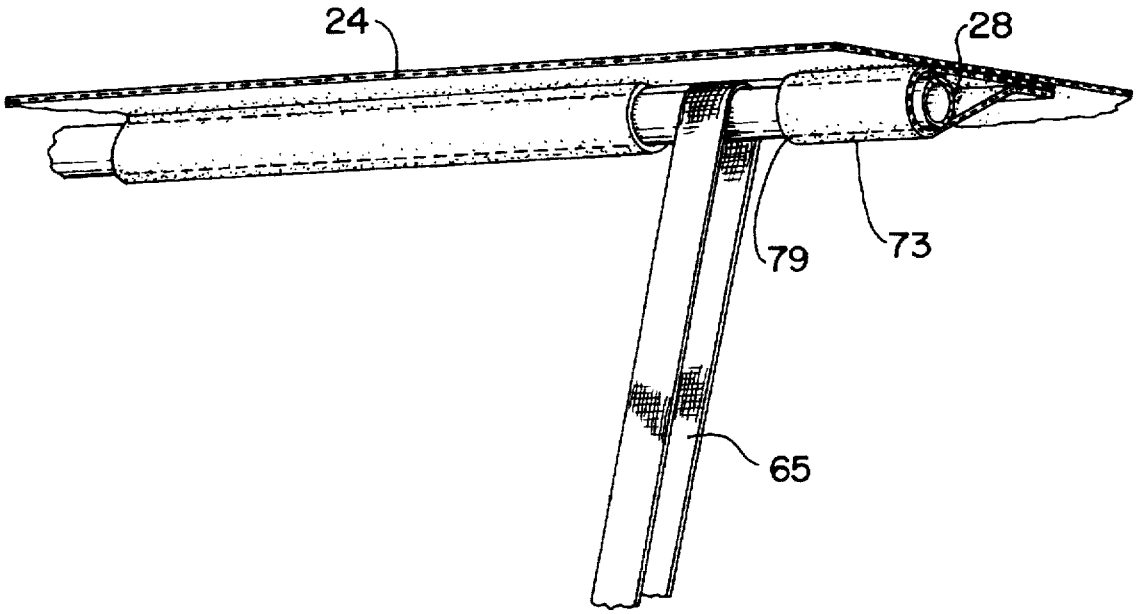
FIG. 7 is a partial view in perspective illustrating the attachment of the straps to the U-shaped linkage.

The four straps 61, 63, 65, and 67 are attached in such a manner as to hold the canopy in the raised and opened position. Hence two straps 61 and 63 are attached to the fore end of the canopy and two straps 65 and 67 are attached to the aft end of the canopy. Each of the four straps 61, 63, 65, and 67 loop around the base portion of the appropriate U-shaped links and the appropriate eyelet 70 and are tensioned by the buckle 78. As shown in FIG. 7, the strap is looped around the link's 28 cross or base portion and extends through openings 79 formed in the sleeve portion 73 of the canopy. Each of the straps is also attached to eyelet 70 that is bolted to the hull of the watercraft by a quick release snap clip 72. Snap clip 72 is fitted to each of the straps by the aperture formed in ring portion 74 of clip 72. Obviously this connection serves as a quick and easy release from the eyelet 70. Since the load is absorbed by the straps mounted in the bow of the watercraft, it may be necessary to locate a load plate 80 on the underside of the skin of the watercraft to support that particular eyelet 70, as shown in FIG. 6. While two straps are preferably mounted in both the stern and bow of the water craft, the exact locations may be selected for any given application so long as the straps provide a fore and aft tension on the canopy and linkage system. The straps are adjustable and are tensioned so as to level the canopy or locate it in any desired position. Obviously, to obtain the least resistance from the wind during cruising of the watercraft, the canopy should be disposed parallel to the hull.

As mentioned in the early part of the disclosure, the canopy can also be used as an umbrella or cabana as shown in FIG. 3. To release the canopy from the watercraft, the operator simply unfastens the four straps 56, removes the pin 41 from the camel back fastened to the main U-shaped link 28 and sets the canopy on the ground or beach where desired. The end of the leg portions 42 and 44 are submerged into the ground or sand and the two straps at the fore end of the canopy are anchored into the sand by use of stakes 80 and 82 or any other securing device. An example of a suitable anchoring device is the commercially available tent stakes.

Figure 8:
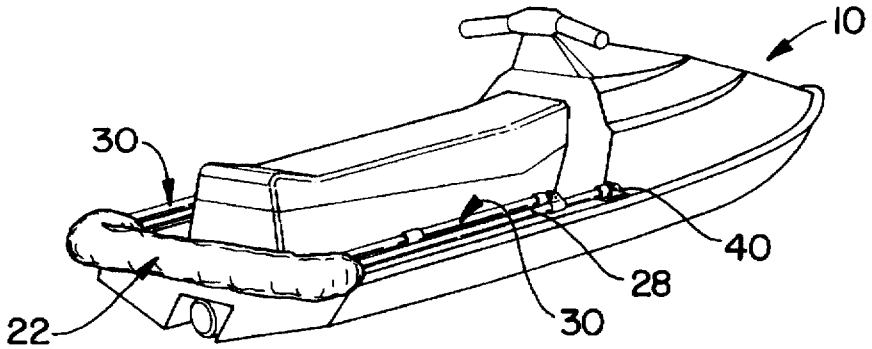
FIG. 8 is a perspective view showing the convertible top in the down position.

As is apparent from the foregoing, the link system is pivotable so that the leg portions of each of the links 28, 30 and 32 fold to an abutment relationship. As shown in FIG.8, when the canopy is folded for the down position, it is pivoted to lie on the deck at the stern of the water craft so as to afford the least resistance to the wind and not interfere with the operation of the watercraft.

As is also apparent from the foregoing, by folding the canopy it becomes easy to carry and store without taking up much room.

Although this invention has been shown and described with respect to detailed embodiments thereof, it will be appreciated and understood by those skilled in the art that various changes in form and detail thereof may be made without departing from the spirit and scope of the claimed invention.

I claim:

1. A convertible top for a multiple seat jet boat having a hull including a canopy top and a linkage system, said linkage system including a main U-shaped link, means for pivotally attaching said main link to the hull of said jet boat and said canopy, a first intermediate U-shaped link pivotally attached to said main U-shaped link in proximity to said hull and attached to said canopy and a second intermediate U-shaped link pivotally attached to said first intermediate link and attached to said canopy, strap means for anchoring said canopy to said jet boat, said canopy including a fore end at the bow of said jet boat and an aft end at the stern of said jet boat, said U-shaped main link including a first leg and second leg and a base portion interconnecting said first leg and said second leg, eyelet means affixed to the end of said first leg and said second legs and means for pivotally attaching said eyelet means to said jet boat and said base portion to the aft end of said canopy, said first intermediate link includes a first leg and a second leg and a base interconnecting said first leg and said second leg, said second intermediate link having a first leg and a second leg and a base interconnecting said first leg and said second leg, said base of said first intermediate link being attached to said fore end of said canopy and said base of said second intermediate link being attached to said canopy at a location intermediate said fore end and said aft end and means for pivotally attaching said first leg and said second leg of said first intermediate link to said main link and means for pivotally attaching said first leg and said second leg of said second intermediate link to said first intermediate link, whereby said canopy is deployed in an upright position to shield the riders of the water craft from the sun and is returned to a folded position to lie on the hull of the jet boat.

2. A convertible top for a multiple seat jet boat as claimed in claim 1 wherein said main link, said first intermediate link and said second intermediate link are made from a tubular member.

3. A convertible top for a multiple seat jet boat as claimed in claim 2 wherein said tubular member is made from stainless steel.

4. A convertible top for a multiple seat jet boat as claimed in claim 3 wherein the dimension of the outer diameter of said tubular member is substantially equal to ⅞ inch.

5. A convertible top for a multiple seat jet boat as claimed in claim 1 wherein said strap means includes a first strap attached to the said base of said main link and a second strap attached to said base of said first intermediate link.

6. A convertible top for a multiple seat jet boat as claimed in claim 5 wherein said means for attaching said main link is a camel back fitting.

7. A convertible top for a multiple seat jet boat as claimed in claim 4 wherein the thickness of the wall of said tubular member is substantially equal to 0.049 inch.

8. In combination a convertible top for a multiple seat cruiser jet boat and umbrella comprising a canopy and linkage system, said linkage system including a main U-shaped link, means for pivotally and removably attaching said main link to said jet boat and means for attaching said main link to said canopy, a first intermediate link pivotally attached to said main U-shaped link in proximity to said hull and attached to said canopy, a second intermediate link pivotally attached to said first intermediate link and attached to said canopy and strap means for anchoring said canopy to said jet boat, said canopy including a fore end and an aft end, said strap means including at least one strap attached to said fore end and at least another strap attached to said aft end, said main link, said first intermediate link and said second intermediate link each including a base portion, means for attaching said base portion to said canopy wherein said main link extends to the aft end of said canopy, said first intermediate line extends to the fore end of said canopy and said second intermediate link attaches to said canopy at a point intermediate said fore end and said aft end of said canopy and means for tensioning said strap means for positioning said canopy relative to said hull, and said strap means and said main link being releasable from said jet boat for removing said canopy and linkage system from said jet boat for usage as an umbrella on the ground.

9. In combination a convertible top for a multiple seat cruiser jet boat and umbrella as claimed in claim 8 wherein said main link, said first intermediate link and said second intermediate link are made from a tubular member.

10. In combination a convertible top for a multiple seat cruiser jet boat and umbrella as claimed in claim 9 wherein said tubular member is made from stainless steel.

11. In combination a convertible top for a multiple seat cruiser jet boat and umbrella as claimed in claim 10 wherein the dimension of the outer diameter of said tubular member is substantially equal to ⅞ inch.

12. In combination a convertible top for a multiple seat cruiser jet boat and umbrella as claimed in claim 11 wherein the thickness of the wall of said tubular member is substantially equal to 0.049 inch.

13. In combination a convertible top for a multiple seat cruiser jet boat and umbrella as claimed in claim 12 wherein said means for attaching said main link is a camel back fitting.

* * * * *